US006411263B1

(12) United States Patent
Neilson

(10) Patent No.: US 6,411,263 B1
(45) Date of Patent: Jun. 25, 2002

(54) MULTI-MODE HORN

(75) Inventor: Jeffrey M. Neilson, Redwood City, CA (US)

(73) Assignee: Calabazas Creek Research, Inc., Redwood City, CA (US)

( * ) Notice: Subject to any disclaimer, the term of this patent is extended or adjusted under 35 U.S.C. 154(b) by 0 days.

(21) Appl. No.: 09/675,449

(22) Filed: Sep. 28, 2000

(51) Int. Cl.[7] ..... H01Q 13/00
(52) U.S. Cl. ..... 343/786
(58) Field of Search ..... 343/786, 753; H01Q 3/00

(56) References Cited

U.S. PATENT DOCUMENTS

RE23,051 E * 11/1948 Carter ..... 343/786
3,413,641 A 11/1968 Turrin
3,413,642 A 11/1968 Cook
3,482,252 A 12/1969 Nagelberg
3,530,481 A 9/1970 Tanaka et al.
4,122,446 A 10/1978 Hansen
4,878,059 A * 10/1989 Yukl ..... 343/753

OTHER PUBLICATIONS

Spurious Mode Generation in Non Uniform Waveguide, L. Solymar, IRE Transactions on Microwave Theory and Techniques, 1959, pp. 379.

* cited by examiner

*Primary Examiner*—Michael C. Wimer
(74) *Attorney, Agent, or Firm*—Jay A. Chesavage

(57) ABSTRACT

A horn has an input aperture and an output aperture, and comprises a conductive inner surface formed by rotating a curve about a central axis. The curve comprises a first arc having an input aperture end and a transition end, and a second arc having a transition end and an output aperture end. When rotated about the central axis, the first arc input aperture end forms an input aperture, and the second arc output aperture end forms an output aperture. The curve is then optimized to provide a mode conversion which maximizes the power transfer of input energy to the Gaussian mode at the output aperture.

24 Claims, 3 Drawing Sheets

MULTI-MODE HORN

The U.S. Government has a paid-up license in this invention and the right in limited circumstances to require the patent owner to license others on reasonable terms as provided for by the terms of NASA Grant No. NAS3-00079 awarded by NASA.

FIELD OF THE INVENTION

This invention relates to an apparatus and method for a dual multi-mode horn for Gaussian mode generation. The development of millimeter and sub-millimeter wave sources requires a structure for coupling these waves in a directional manner from a waveguide to the surrounding environment, commonly accomplished using a class of structures known as dual-mode horns. The function of a dual-mode horn is to provide mode conversion from the TE11 mode inside the waveguide to a Gaussian radiation pattern at the exit aperture of the horn. The larger the Gaussian radiation pattern at the output of the horn, the narrower the beamwidth in the far field, as is known using the methods of Fourier optics. According to the methods of Fourier optics, the production of a narrow beamwidth is related inversely to the size of the radiating aperture, and truncation of the radiation pattern at the extents of the aperture produce sidelobes, which subtract from the power in the main lobe, and broaden the far field beamwidth. For transmission of millimeter and sub-millimeter RF power, the Gaussian radiation pattern is preferred since it propagates through space without change in its transverse profile.

BACKGROUND OF THE INVENTION

In prior art systems, the proposition of developing a horn structure for producing a broad radiation aperture has been handled several different ways.

U.S. Pat. No. 3,413,641 by Turrin comprises a first circular waveguide coupled to a conical section, and followed by a circular output waveguide.

FIG. 1 shows U.S. Pat. No. 3,413,642 by Cook, where a horn 10 is driven by a source 12, and higher modes waves are suppressed in waveguide 14, which is followed by conical section 16, which includes a plurality of irises 18 which perform modal conversion, thereby reducing the wall currents in the output aperture 20. The irises 18 are circularly symmetric rings having a spacing which is less than a wavelength.

U.S. Pat. No. 3,482,252 by Nagelberg comprises a circular input waveguide followed by a step change in radius to a second waveguide, which is followed by a conical taper leading to an output aperture. The step change in radius produces mode conversion, thereby reducing the wall currents of the second waveguide.

FIGS. 2*a* and 2*b* show U.S. Pat. No. 3,530,481 by Tanaka, and comprises a horn 30 fed by a waveguide 32 which presents a series of counter-propagating step discontinuities 34 followed by a conical tapered guide 30 having an exit aperture 36. FIGS. 3*a* and 3*b* show the similar structure of U.S. Pat. No. 4,122,446 by Hansen where a horn 40 has an input waveguide 42, a series of co-propagating step discontinuities 44, an output waveguide 46, and an output aperture 48. The step discontinuities 44 provide for the creation of higher order modes which combine to produce lower wall currents in output waveguide 46, thereby producing a narrow far field beam width.

For microwave wavelengths in the X band region of 10 Ghz, a wavelength in free air is about 3 cm, so the prior art step and iris structures would have periodicity on the order of 0.3 cm, which is straightforward to fabricate using current machining technology. When the frequency of propagation is in the region of 600 Ghz, the corresponding wavelength in free air is 0.5 mm, and producing the step structures on the order of 50 microns as shown in the prior art becomes very difficult, since the material finish has roughness which exceeds the required step function value. A new horn structure is needed which has the advantages of the prior art horn structures, but has a physical size which is compatible with current materials fabrication practice.

SUMMARY OF THE INVENTION

A circularly symmetric horn having a central axis of symmetry has an input aperture and an output aperture. The horn is formed by rotating a first arc having an input aperture end, a transition end, the first arc also having a first radius of curvature. A second arc has a transition end and an output aperture end and a second radius of curvature. The transition end of the second arc is connected to the transition end of the first arc. When the two arcs are rotated about the central axis, they form a surface having an input aperture and an output aperture. The two arcs are separated by a distance roughly equal to the beat period of the TE11 and TM11 modes. Typically, the first arc is concave from the perspective of the central axis, and the second arc is convex from the perspective of the central axis.

OBJECTS OF THE INVENTION

A first object of the invention is a radiating mode converting horn having reduced wall currents at the output aperture.

A second object of the invention is a horn which produces a Gaussian radiation pattern.

A third object of the invention is a horn which has a Gaussian coupling factor in excess of 0.95.

A fourth object of the invention is a horn which produces less than 0.05 of its output power in spurious modes.

DETAILED DESCRIPTION OF THE INVENTION

Figure 1:
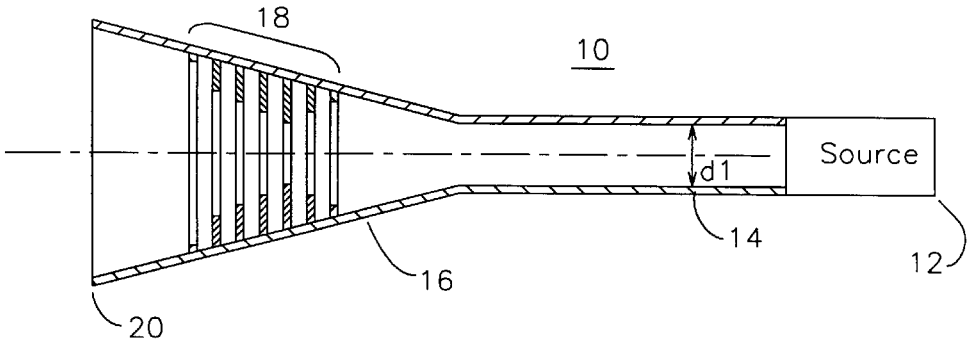
Figure 1 Prior Art
FIG. 1 shows a prior art horn with a plurality of irises for the introduction and mixing of modes.
Figure 2B:
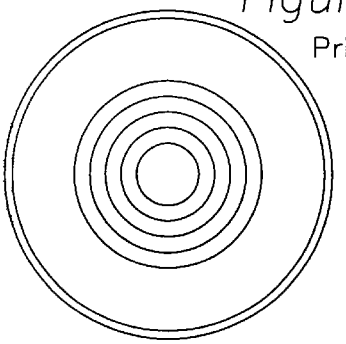
Figure 2b Prior Art
FIGS. 2*a* and 2*b* show a prior art horn having counter-propagating step discontinuities.
Figure 2A:
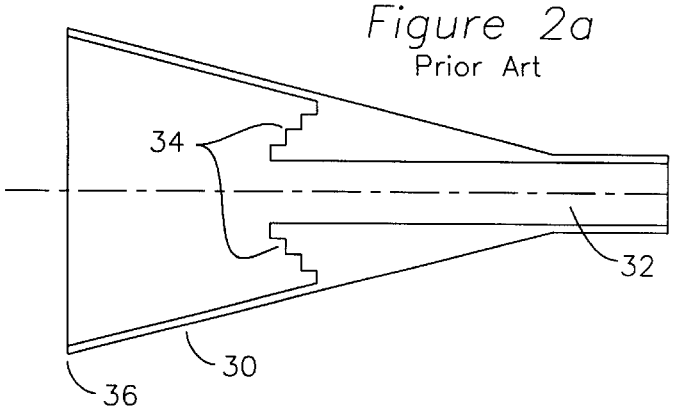
Figure 2a Prior Art
Figure 3B:
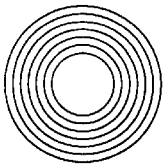
Figure 3b Prior Art
FIGS. 3*a* and 3*b* show a prior art horn having co-propagating step discontinuities.
Figure 3A:
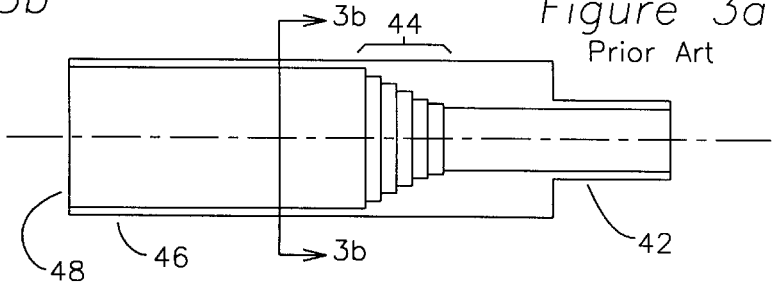
Figure 3a Prior Art
Figure 4:
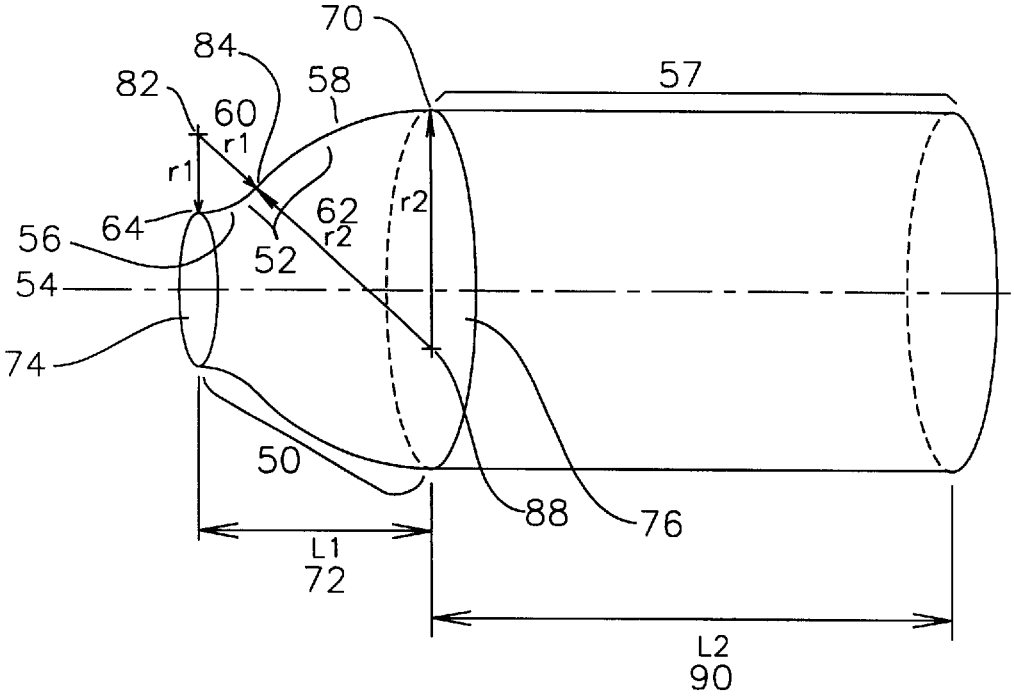
FIG. 4 shows a mode converting horn.

FIG. 4 shows the horn of the present invention, and comprises a mode converting horn 50 coupled to a section 57 which adjusts the central fields of the TE11 and TM11 modes to be in phase at the output aperture. A horn 50 is formed by rotating a curve 52 about a central axis 54. The curve 52 is formed by a first arc 56 having a first radius of curvature r1 60 about a first center 82 and a second arc 58 having a second radius of curvature r2 62 about a second center 88. First curve 56 has an input aperture end 64 and a transition end 84, and second curve 58 has a transition end 84 and an output aperture end 70. When curve 52 is rotated about central axis 54, input aperture end 64 forms a circular input aperture 74, and output aperture end 70 forms an output aperture 76 suitable for radiation into free space after the TE11 and TM11 modes are phased properly. The slope of input aperture end 64 of first arc 56 is parallel to the central axis 54, and the slope of output aperture end 70 of second curve 58 is parallel to the central axis 54. The horn has a horn length 72, which may be followed by a phase adjusting length L2 90, and the inner surface of the horn and phase adjustment section is formed from an electrically conductive material such as copper, aluminum, or another material such as gold may be formed over the base material through a plating process, as is well known to one skilled in the art.

Figure 5A:
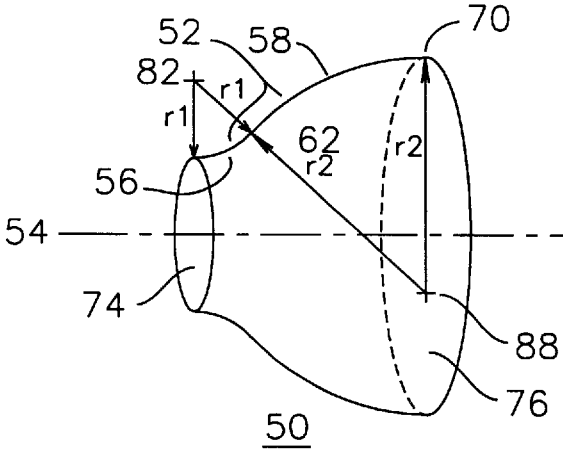
FIGS. 5*a* and 5*b* show the radius of curvature for two embodiments of a mode converting horn.

FIG. 5 shows two embodiments of the present horn. FIG. 5*a* shows the curve 52 formed by first curve 56 and second curve 58. In this example, the first arc 56 is convex with respect to the central axis 54, and second arc 58 is concave with respect to the central axis 54. Furthermore, the center 88 of the second arc 58 is found below the central axis 54, and may reside in any location below curve 58. Since the slope of the output aperture end 70 of second curve 58 should be parallel to the central axis 54, the center 88 of second arc 58 will be located within the plane formed by the output aperture 76. Similarly, the center 82 of the first arc 56 will be located on the plane formed by the input aperture 74. In this manner, the tangent of the input aperture end and the tangent of the output aperture end of the horn will be parallel to the central axis 54.

Figure 5B:
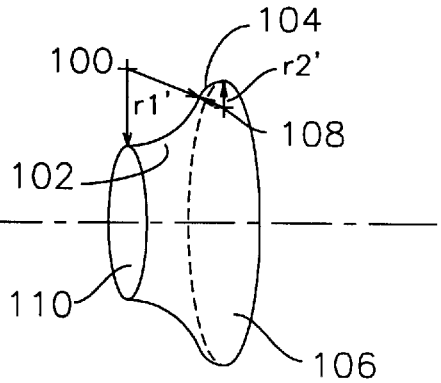

FIG. 5*b* shows a similar horn produced by rotating a curve formed by first arc 102 and second arc 104. In this example, the center 100 of first arc 102 is located on a plane formed by the input aperture 110, and the center 108 of second arc 104 is located in the plane formed by the output aperture 106, but the center 108 of second arc 104 is located between the central axis 54 and the output aperture end of second arc 104. In this manner, the center of the first arc will be found on the plane of the input aperture, and the center of the second arc will be found in the plane of the output aperture, and the center of the second arc may be found anywhere which produces a concave arc with respect to the central axis.

It is desired that the horn of FIG. 4 convert the incoming TE11 wave into higher order waves (TM11,TE12, . . . ) at input aperture 74 through mode conversion with the majority of the power in the TE11 and TM11 modes. It is further desired that the superposition of modes reduce the wall current at the output aperture 76 to a minimum. The interrelated variable parameters of FIG. 4 are the length 72, the first radius 60, the second radius 62, the input aperture 74 diameter, and the output aperture 76 diameter. In practice, it is often desired to identify fixed parameters, and to choose a shape using the remaining parameters. In a typical application, the diameter of the input aperture 74 is matched to the waveguide feeding the horn, and the output aperture 76 is governed by the desired beamwidth at a given distance, as is known to one skilled in the art of Fourier transform radiation patterns. It is further desired to maximize the Gaussian coupling factor, which is a measure of the energy within the desired Gaussian profile, and generally it is desired to minimize wall currents at the aperture which result in the production of side radiation lobes. In this manner, the remaining variables modified by the designer of the horn 50 are the first radius of curvature 60 and the length 72. Using the method developed by Solymar (L.Solymar, "Spurious Mode Generation in Nonuniform Waveguide", IRE Trans. MTT, 1959, pg379–383) to calculate the mode content at the output aperture, the fractional coupling to a Gaussian is given by the following equation:

$$\sum_N An \int \vec{E}_{00}(r, \phi) \cdot \vec{E}_N(r, \phi) ds$$

Where E00 and En are the fundamental Gaussian beam mode and waveguide mode functions respectively, and An is the waveguide mode amplitude.

Figure 6A:
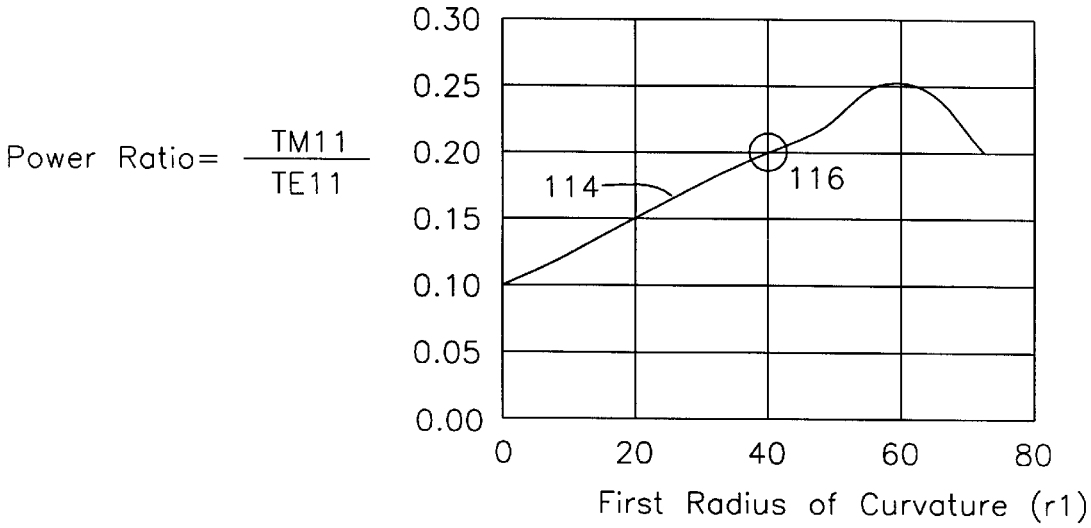
FIG. 6*a* show the graph of power transfer as a function of first radius of curvature for the horn of FIG. 4.
Figure 6B:
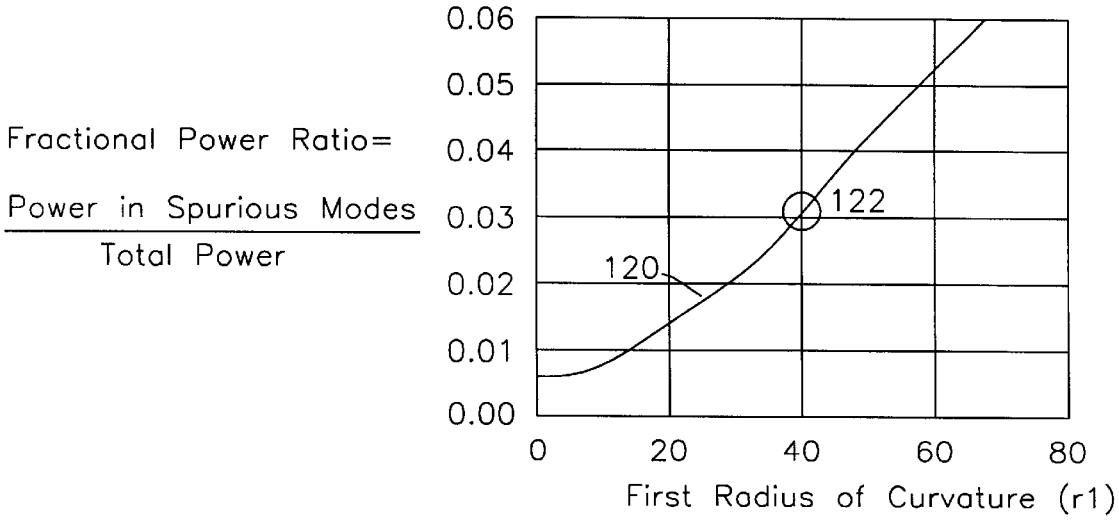
FIG. 6*b* shows the graph of spurious mode power as a fraction of the total power for the horn of FIG. 4.

An initial choice is made for the horn length, which may be on the order of the beat period between TE11 and TM11. The final choice for the horn length is governed by a the desired power ratio (~0.2 for Gaussian mode, ~0.4 for minimum sidelobe radiation), with low spurious modes having a total power of under 3% of the total output power. For an initially chosen overall horn length, a minimum length can be found by optimizing the power ratio with the spurious modes, and in the previous example, a length of 20 mm produced the desired power ratio and spurious output power. Shorter lengths produce the proper power ratio but the spurious mode content is excessive. Longer lengths reduce the spurious mode content for a desired power ratio. The final length of 20 mm was the smallest length in which the power ratio was ~0.2 and the spurious mode content <3%). FIG. 6*a* shows the effect of varying the first radius of curvature on the ratio of TM11 to TE11, referred to as power ratio, shown as curve 114. The power ratio produces a value which is related to the Gaussian coupling factor, a measurement of how closely the radiation pattern matches the desired Gaussian curve. FIG. 6*b* shows the effect of varying the first radius of curvature on the ratio of power in undesired high order modes to the total power, referred to as fractional power ratio, and shown as the curve 120. Initially, the first radius of curvature 60 is selected based on the power ratio. A power ratio of 0.4 results in minimum field at the aperture wall and a Gaussian coupling factor of 0.96, while a power transfer ratio of 0.2, results in a higher Gaussian coupling factor of 0.98 and wall currents at the aperture, resulting in the production of sidelobes. In FIG. 6*a*, the power ratio is shown at point 116 to produce a value of 0.2, which is in the design range, and spurious fractional power ratio of 3% at point 122 of curve 120 of FIG. 6*b*. Continuing to a higher first radius of curvature would produce a slightly higher power ratio, but it can be seen from curve 120 of FIG. 6*b* that this would produce sharply higher levels of power in undesired high order modes, which come at the expense of efficiency, since these modes represent wasted energy. It can be seen that the first radius of curvature of 40 mm produces an reasonable tradeoff between Gaussian beam shape and minimal high order mode energy loss.

It is possible to further optimize the shape produced by the resultant parameters of the above illustration where length L2 72=20 mm and the first radius of curvature=40 mm. This shape may be curve fit to a cubic spline and subjected to numerical optimization by changing parameters via Newton's method wherein additional improvements in power transfer ratio occur. Since the starting value of Gaussian power transfer ratio is quite high at about 0.95, only a small additional incremental improvement is produced by this additional effort compared to the initial efficiency of the structure described herein.

It is clear to one skilled in the art that the example provided herein is to show the design methodology of the present invention, and is not intended to suggest that the horn must be designed in the particular manner shown. For example, the interrelated design parameters of input aperture diameter, output aperture diameter, length, first radius of curvature and second radius of curvature are all interrelated, and the order in which the parameters were chosen were for example only, and not intended to limit the scope of the invention. It is clear to one skilled in the art that modeling a short period sine wave with a physical length equal to the electrical beat period of the TE11 and TM11 in a given dielectric by using two arcs having different radii of curvature may be accomplished using many different shapes, including a sine wave having a nonlinear correction factor, and the like. The use of two interconnected arcs having two independent radii of curvature is shown by example only.

I claim:

1. A multi-mode horn carrying transverse electric (TE) and transverse magnetic (TM) waves and having an input aperture and an output aperture, said horn comprising:

an electrically conductive inner surface formed by rotating a curve about a central axis, said curve comprising a first arc having a first radius of curvature and a second arc having a second radius of curvature, said first arc having an input aperture end and a transition end, said second arc having a transition end and an output aperture end, said first arc input aperture end forming said input aperture, said first arc transition end connected to said second arc transition end, and said second arc transition end forming said output aperture.

2. The horn of claim 1 wherein said first arc input aperture end has a slope which is parallel to said central axis, and said second arc output aperture end has a slope which is parallel to said central axis.

3. The horn of claim 1 or claim 2 wherein said first arc is convex with respect to said central axis.

4. The horn of claim 1 or claim 2 wherein said second arc is concave with respect to said central axis.

5. The horn of claim 1 or claim 2 wherein said horn produces a Gaussian power coupling greater than 0.95.

6. The horn of claim 1 or claim 2 wherein said horn produces a spurious power ratio of less than 0.05.

7. The horn of claim 1 or claim 2 wherein said horn includes a phase adjustment section having a diameter equal to said output aperture, said phase adjustment section coupled to said horn output aperture.

8. The horn of claim 1 wherein said horn receives electro-magnetic waves.

9. The horn of claim 1 wherein said horn transmits electromagnetic waves.

10. A horn for carrying transverse electric (TE) and transverse magnetic (TM) waves, said horn having an electrically conductive inner surface, said inner surface formed by rotating a curve about a central axis, said curve comprising:

a first arc which is convex with respect to said central axis, said arc having an input aperture end and a transition end;

a second arc which is concave with respect to said central axis, said arc having a transition end and an output aperture end, said second arc transition end intersecting said first arc transition end;

said horn having an input aperture formed by said curve first arc input aperture end rotated about said central axis;

said horn having an output aperture formed by said curve second arc output aperture end rotated about said central axis.

11. The horn of claim 10 wherein said first arc radius and said second arc radius are chosen to produce a Gaussian transfer ratio in excess of 0.05.

12. The horn of claim 10 wherein said first arc radius and said second arc radius are chosen to produce a spurious mode output less than 0.05.

13. The horn of claim 10 wherein said length is chosen to produce a Gaussian transfer ratio in excess of 0.95.

14. The horn of claim 10 wherein said horn includes a phase adjustment section having a diameter equal to said output aperture, said phase adjustment section coupled to said horn output aperture.

15. The horn of claim 10 wherein said horn receives electro-magnetic waves.

16. The horn of claim 10 wherein said horn transmits electro-magnetic waves.

17. A process for selecting the parameters of a horn, said horn formed by rotating a curve about a central axis, said curve formed from a first arc having a first radius of curvature, a second arc having a second radius of curvature, said horn having a length, said parameters comprising any two of said parameters said length, said first radius of curvature, and said second radius of curvature, said process comprising the steps:

forming a Gaussian transfer ratio by comparing the output power to the power in a Gaussian emission, and evaluating said Gaussian transfer ratio while varying said parameters;

forming a spurious mode ratio by comparing the power in undesired modes to the total emitted power, and evaluating said spurious mode ratio while varying said parameters;

choosing said length to be a minimum value which produces said power ratio in excess of 0.2 while minimizing said spurious output ratio;

varying said first radius of curvature while optimizing said Gaussian transfer ratio and minimizing said spurious modes, and holding said length constant.

18. The method of claim 17 wherein said curve is further optimized to produce a maximum said Gaussian transfer ratio using numerical optimization such as provided by Newton's method.

19. The method of claim 17 wherein said curve is further optimized to produce a minimum said spurious mode output using the numerical optimization such as provided by Newton's method.

20. The method of claim 17 wherein said horn has an input aperture formed by rotating said first arc about said central axis, and said input aperture is fixed during said method.

21. The method of claim 17 wherein said horn has an output aperture formed by rotating said second arc about said central axis, and said output aperture is fixed during said method.

22. The horn of claim 17 wherein said horn includes a phase adjustment length having a diameter equal to said output aperture, said phase adjustment length coupled to said horn output aperture.

23. The horn of claim 17 wherein said horn receives electro-magnetic waves.

24. The horn of claim 17 wherein said horn transmits electro-magnetic waves.

* * * * *